US005651551A

United States Patent [19]

Ferrara et al.

[11] Patent Number: 5,651,551

[45] Date of Patent: Jul. 29, 1997

[54] PORTABLE SOCCER GOAL

[75] Inventors: Mark Ferrara, Smithfield, R.I.; Brian E. Bergman, Uncasville, Conn.

[73] Assignee: Jaypro Sports, Inc., Waterford, Conn.

[21] Appl. No.: 635,774

[22] Filed: Apr. 22, 1996

[51] Int. Cl.[6] ..... A63B 63/00

[52] U.S. Cl. ..... 273/400

[58] Field of Search ..... 273/395, 396, 273/398, 400, 411

[56] References Cited

U.S. PATENT DOCUMENTS

| | | | |
|---|---|---|---|
| 4,258,923 | 3/1981 | Senoh | 273/398 |
| 5,238,243 | 8/1993 | Grispi | 273/400 X |
| 5,273,292 | 12/1993 | Pardi et al. | 273/400 |

*Primary Examiner*—William H. Grieb

*Attorney, Agent, or Firm*—Kane, Dalsimer, Sullivan, Kurucz, Levy, Eisele and Richard

[57] ABSTRACT

A portable soccer goal assembly is described. The goal assembly is substantially stable against tipping over even when individuals climb upon the crossbar, as occurs frequently when the goal assembly is accessible at opportune moments.

1 Claim, 2 Drawing Sheets

PORTABLE SOCCER GOAL

BACKGROUND OF THE INVENTION

1. Field of Invention

The invention relates to sporting equipment and more particularly to a portable soccer goal.

2. Brief Description of Related Art

Portable soccer goals have found a need in the art and have been described, for example, in the U.S. Pat. Nos. 4,127,272; 5,080,375; 5,186,469; and 5,273,292. Although these patents describe many improvements in the art of portable soccer goals, there remains a need for still further improvements, particularly in respect to safety features for the protection of players and public. For example, recently (December 1995) the European Committee for Standardization has set forth physical specifications for materials and dimensions of which football (soccer) goals are manufactured. The standard, European Standard EN 748: 1995, requires among other things that the goal have sufficient stability to resist a horizontal force of 1 100N at the top of the center of the goal crossbar for 1 min $^{+10}_{-0}$S. by not falling over or sliding on the ground surface. Although the standard is not applicable or mandated for goals used in the Americas, it highlights the interest in improving safety features for goals.

For example, the U.S. Consumer Product Safety Committee (USCPSC) has determined that portable official soccer goals should be anchored or counterweighted at all times. For this purpose, several portable goal anchors are commercially available. For example, Jayfro, 976 Hartford Turnpike, Waterford, Conn. 06385 makes available auger style anchors, spike anchors, J-Hook stakes and sleeve anchors for anchoring portable soccer goals. In spite of the wide variety of anchor systems available, they are generally not fully employed for as many reasons as there are systems. More specifically, the particular anchor selected must be matched to the type of ground surface upon which the soccer goal is to be anchored. Sandy soils require a different anchor than hard clay soils. Rocky soils are difficult to drive an anchor into. An Astroturf® surface is subject to damage by any anchor system. Anchors are subject to loss in high grass. Most importantly, the time and labor involved in anchoring a goal, moving the goal to a new location and re-anchoring it inhibits their use. There is a tendency on the part of the play supervisors to neglect the proper installation of a ground anchor system.

The exploitation of counterweights to anchor portable soccer goals has heretofore been limited to the use of sandbags or excessively heavy units of limited portability. This too has disadvantages in that sandbags require maintenance, protection from the weather elements and can easily be lost or subjected to misuse in handling.

The portable goals of the present invention are relatively light and readily portable. They need not be anchored to the ground, but because of their weight distribution design, they resist tipping over and resist being pushed along the ground surface.

SUMMARY OF THE INVENTION

The invention comprises a stable, portable soccer goal, which comprises;

an open frame defining the goal opening and having an inverted "U" shape with a crossbar between two downwardly projecting, parallel legs;

the parallel legs each having a first end and a second end, the first ends being connected to the crossbar and the second ends attached to means for support on a ground surface;

means for support on a ground surface comprising elongate members extending from the second end of a leg away from the goal opening; and a center of gravity at a point between the legs, below the crossbar and beyond the center of the elongate members, distal to the goal opening.

DETAILED DESCRIPTION OF THE PREFERRED EMBODIMENTS OF THE INVENTION

Figure 1:
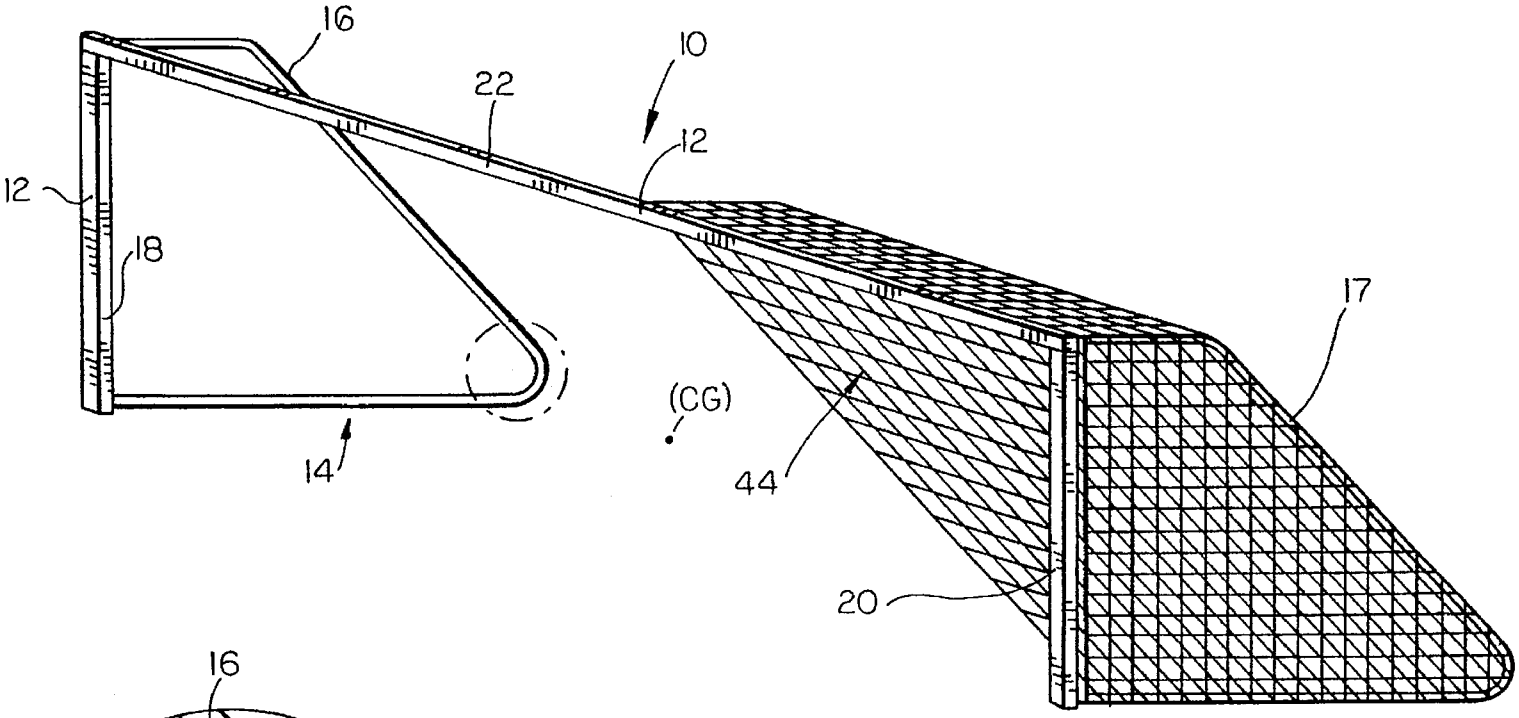
FIG. 1 is a view-in-perspective of a preferred embodiment goal of the invention.
Figure 3:
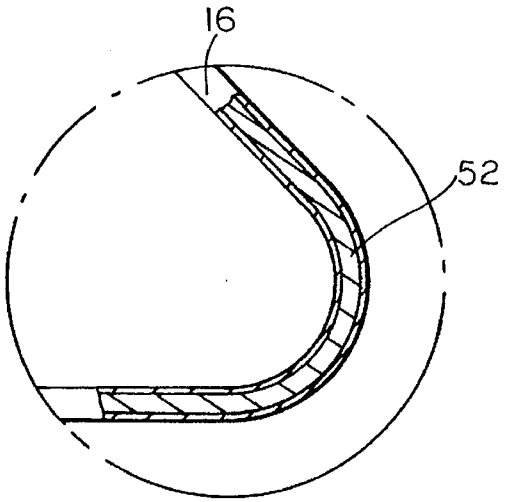
FIG. 3 is a cut-away view of an end of the means for ground support.
Figure 2:
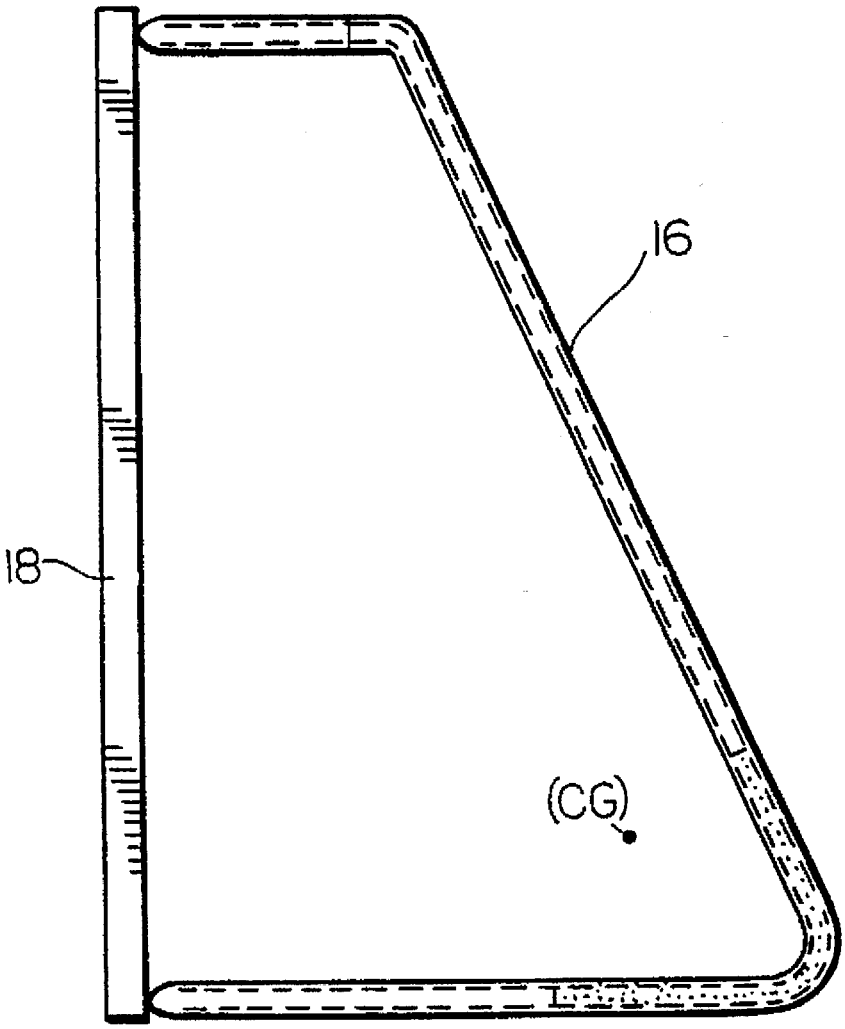
FIG. 2 is a side elevation of the embodiment seen in FIG. 1.

Those skilled in the art will gain an appreciation of the invention from the following description of preferred embodiments, when read in conjunction with a viewing of the accompanying drawings of FIGS. 1–3, inclusive.

FIG. 1 is a view-in-perspective of a preferred embodiment portable goal assembly 10 of the invention. The assembly 10 is a stable, portable soccer goal assembly comprising a frame 12 having an inverted "U" shape. Legs 18, 20 form components of frame 12 and are parallel to each other and project downward from the crossbar 22. The frame 12 defines the goal opening or mouth 14 for receiving a soccer ball during play. Embodiment means for ground support are elongate, tube members 16, 17 which are secured to the free ends of the inverted "U" of frame 12, to lie on a ground surface, and to stabilize frame 12 in an upright, vertical position. There are two elongate members 16, 17, one disposed on each side of the crossbar 22 and extending distally away from the goal mouth 14. The members 16, 17 are of a length and weight to counter balance the weight of frame 12, as will be described more fully hereafter.

In the most preferred embodiments of assembly 10, frame 12 is connected to the members 16, 17 on each side of assembly 10, preferably by welding.

In the most preferred embodiment of the goal assembly 10 of the invention, the first vertical post 18 and the second vertical post 20 of frame 12 constitute elongate members, each having first and second ends. The horizontally disposed crossbar 22 is secured in conventional manner to the first ends of vertical posts 18, 20. For example, the components may be welded or bolted together. Advantageously, the frame 12 is fabricated from lightweight tubular components having the necessary strength to function as a goal assembly. Elongate members 16, 17 may be fabricated from any conventional materials. For example, they may be made of aluminum, tubular steel or steel alloys. Preferably, for weight considerations, frame 12 is fabricated from aluminum and members 16, 17 are fabricated from tubular steel.

As mentioned earlier, the free second end of vertical leg 18 is connected to the member 16, preferably through the agency of welding. Similarly, upright leg 20 is connected to member 17, preferably through the agency of welding. Members 16, 17 also provide security against lateral movement by virtue of structural resistance to the movement of frame 12 in the direction of the back (inward of mouth 14) of assembly 10. Lateral movement forward of the goal opening 14 is provided by members 16, 17 and the weight of members 16, 17. A ball retaining net 44 shown fragmented in FIG. 1, covers the goal assembly 10 except for mouth 14. The net may be any conventional soccer ball retaining net conventionally employed in like goal assemblies and need only be draped over the goal assembly structure, connected to the crossbar 22 by any conventional means such as hooks, tabs or the like.

FIG. 2 is a side view of the goal assembly 10 shown in FIG. 1 and shows further detail of the construction. In a preferred construction, the members 16, 17 are each a one-piece tube, connected to crossbar 22 and one of legs 18, 20. The member 17 is identical in construction to member 16.

FIG. 3 is a cross-sectional, enlarged cut-away view of a member 16 distal to frame 12.

As shown in FIG. 3, the elongate member 16 is a hollow tubular member partially filled with a counterweight insert 52 secured therein. The insert 52 is counterweight, positioned below the center of gravity ((CG); see FIG. 1 and FIG. 2) and equidistant from the center of gravity of the assembly 10 in a direction away from frame 12. The whole of assembly 10 may weigh, for example, about 225–250 lbs. without the insert 52. The insert 52 adds up to 20 percent more weight to assembly 10, to resist tip-over or sliding of the assembly 10 and may be fabricated from any heavy weight, including a metal such as a steel. The added weight of insert 52 positioned as it is, lowers the center of gravity and moves it away from the frame 12, which enables the assembly 10 to resist a pre-disposition to tip over in a forward direction or slide forward when a lateral force is applied to frame 12 or crossbar 22.

The essence of the invention is the weight distribution found in the goal assembly 10, as a means of achieving stability. To achieve the proper weight distribution, the weight of insert 52 should be positioned a pre-determined distance X from the mouth 14 of the assembly 10. The pre-determined distance X is at least 75% of the height of the crossbar 22 above the ground surface, and need not exceed 125% of that height. For example, if the goal assembly 10 has a crossbar 22 height of 78 inches, the insert 52 should be spaced a distance along member 16 or 17 at least about 50 inches from the goal mouth 14 (or frame 12).

Preferably, the weight distribution of a preferred assembly 10 is calculated by reference to the moment generated by the added weight of insert 52, in foot/lbs. The moment generated has to exceed the weight of the frame 12 by at least a factor of from 2 to 4. This ratio is dependent on the height of the goal crossbar 22 above the ground surface, for safety. An example is an assembly 10 with a frame 12 weighing 70 lbs. and having a height of 8 feet for the crossbar 22. If the counterweight insert 52 is placed 10 feet from the frame 12, the moment generated by a 27 lb. insert 52 is 10×27 or 270 ft./lbs. Since this exceeds the weight of the frame 12 by more than a factor of 2 to 4, stability is assured.

Those skilled in the art will appreciate that many modifications of the above-described preferred embodiments may be made without departing from the scope and the spirit of the invention. For example, as described above, in the preferred assembly 10 of the invention, the insert 52 is housed within the tube members 16, 17 for safety and security. Those skilled in the art will appreciate that alternatively the insert 52 may be fabricated in the form of a sleeve or member to be affixed to the external aspects of the members 16, 17.

What is claimed:

1. A stabilized, portable soccer goal assembly, which comprises;

an open aluminum frame defining a goal opening and having an inverted "U" Shape with a crossbar between two downwardly projecting, parallel legs;

means for support on a ground surface;

the parallel legs each having a first end and a second end, the first ends being connected to the crossbar and the second ends welded to the means for support on a ground surface;

the means for support on a ground surface comprising hollow elongate steel tube members extending from the second end of said legs away from the goal opening and a counterweight insert partially filling the hollow of the steel tube members; and said insert is located a pre-determined distance from the frame, which is at least equal to 75 percent of the height of the crossbar above the means for support on a ground surface whereby there is an assembly center of gravity at a point between the legs, below the crossbar and beyond the center of the elongate members, distal to the goal opening.

* * * * *